US008248313B2

(12) United States Patent
Marcher et al.

(10) Patent No.: US 8,248,313 B2
(45) Date of Patent: Aug. 21, 2012

(54) ANTENNA MODULE AND WIRELESS COMMUNICATION DEVICE USING THE SAME

(75) Inventors: Steven-Philip Marcher, Shenzhen (CN); Zhan Li, Shenzhen (CN); Ye Xiong, Shenzhen (CN); Wei-Dong Hao, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 451 days.

(21) Appl. No.: 12/610,485

(22) Filed: Nov. 2, 2009

(65) Prior Publication Data

US 2011/0063173 A1 Mar. 17, 2011

(30) Foreign Application Priority Data

Sep. 17, 2009 (CN) ..... 2009 1 0307142

(51) Int. Cl.
*H01Q 1/38* (2006.01)

(52) U.S. Cl. ..... 343/702; 343/700 MS; 524/496; 524/507; 361/502; 977/742; 977/750

(58) Field of Classification Search ..... 343/700, 343/702; 361/502; 524/496, 507, 508; 977/742, 977/750, 752

See application file for complete search history.

(56) References Cited

U.S. PATENT DOCUMENTS

| | | | | |
|---|---|---|---|---|
| 6,936,653 | B2 * | 8/2005 | McElrath et al. | 524/496 |
| 7,205,940 | B2 * | 4/2007 | Anazawa et al. | 343/700 MS |
| 7,741,933 | B2 * | 6/2010 | Duwel et al. | 333/187 |
| 7,898,481 | B2 * | 3/2011 | Qian et al. | 343/700 MS |
| 8,127,440 | B2 * | 3/2012 | Douglas | 29/846 |
| 2009/0295644 | A1 * | 12/2009 | Curran et al. | 343/700 MS |
| 2012/0014038 | A1 * | 1/2012 | Meng et al. | 361/502 |

* cited by examiner

*Primary Examiner* — Tho G Phan
(74) *Attorney, Agent, or Firm* — Altis Law Group, Inc.

(57) ABSTRACT

An antenna module includes a radiator made of nanomaterials; the conductivity of the nanomaterials are greater than or equal to about $5.8\times10^7$ S/m. The present further discloses a wireless communication device using the antenna module.

7 Claims, 6 Drawing Sheets

ANTENNA MODULE AND WIRELESS COMMUNICATION DEVICE USING THE SAME

BACKGROUND

1. Technical Field

The present disclosure relates to antenna modules, and particularly, to an antenna module used in a wireless communication device.

2. Description of Related Art

Portable electronic devices, such as mobile phones, personal digital assistants (PDAs) and laptop computers are widely used. Most of these portable electronic devices have a function of receiving frequency modulation (FM) signals.

Portable wireless communication devices typically have no FM antennas to receive FM signals. The conventional portable electronic devices are usually equipped with external accessories (e.g. earphones) that serve as FM antennas to receive FM signals. The earphones have to be inserted/connected to the portable electronic device to carry out the FM signal receiving function. Thus, it is necessary to carry the earphone with the portable electronic device for FM function.

Therefore, there is a room for improvement within the art.

BRIEF DESCRIPTION OF THE DRAWINGS

Many aspects of an antenna module and wireless communication device using the antenna module can be better understood with reference to the following drawings. The components in the drawings are not necessarily to scale, the emphasis instead being placed upon clearly illustrating the antenna module and wireless communication device using the antenna module. Moreover, in the drawings, like reference numerals designate corresponding parts throughout the several views.

DETAILED DESCRIPTION OF THE EMBODIMENTS

Figure 1:
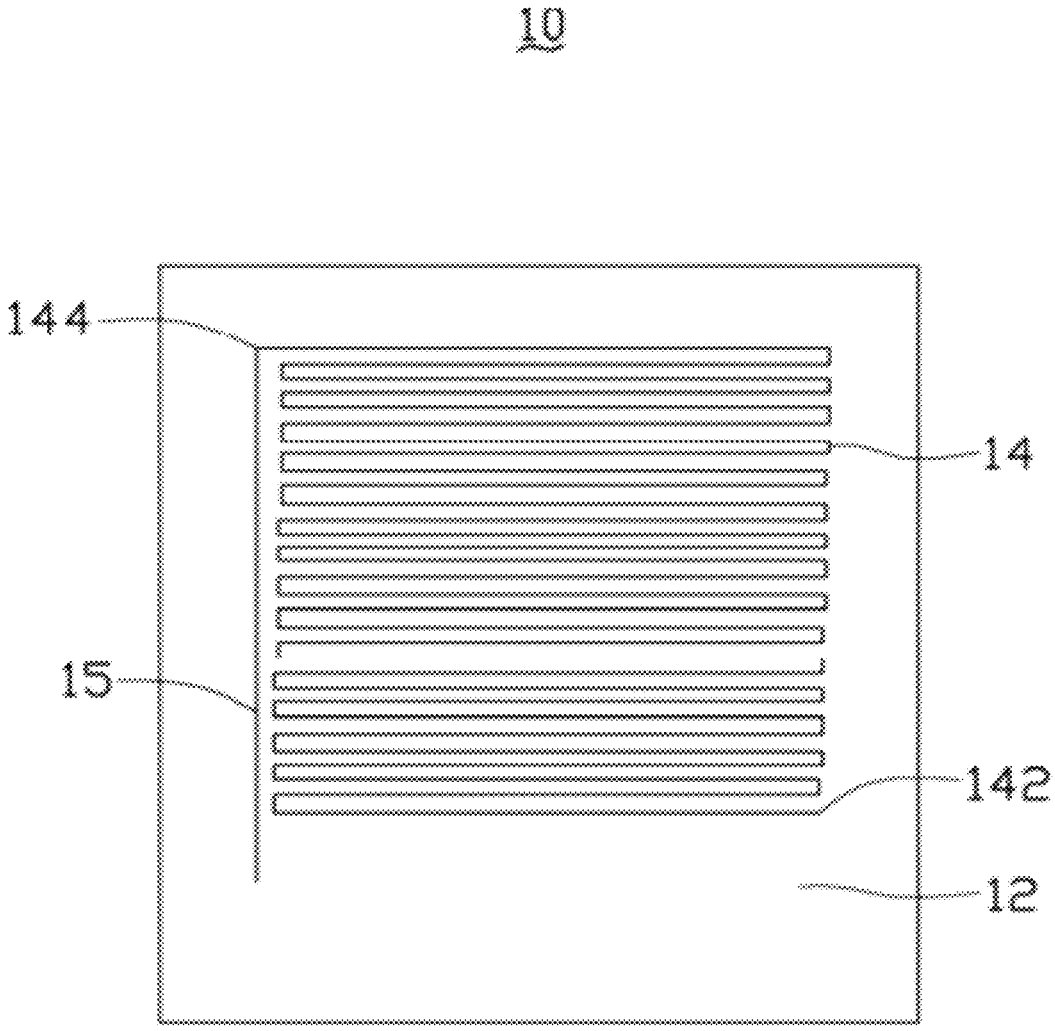
FIG. 1 is a front-on view of an antenna module, according to a first exemplary embodiment.

FIG. 1 shows a first exemplary antenna module 10 including a carrying layer 12 and a radiator 14 formed on the carrying layer 12. The radiator 14 includes a grounding end 142 and a feed end 144.

The carrying layer 12 can be made of an insulating resin material selected from a group consisting of polycarbonate (PC) and acrylonitrile-butadiene-styrene (ABS). The radiator 14 is formed on the carrying layer 12. The radiator 14 can be made of conductive nanomaterials. The conductivity of the nanomaterials are greater than or equal to about $5.8\times10^7$ S/m. In the first embodiment, the radiator 14 is made of carbon nanotube conductive fiber or a compound of poly-3,4-ethylenedioxy thiophene/multi-wall carbon nanotube. The carbon nanotube conductive fiber includes 0.1-5% of carbon nanotube by weight, 0.1-5% of dispersant by weight, and thermoplastic polymer 100% by weight. The dispersant is selected from a group consisting of alkylbenzene sulfonate and alkyl sulfate. The diameter of the carbon nanotube is ranged between about 20 and about 40 nanometers, and the length of the carbon nanotube is ranged between about 200 and about 5000 nanometers. The diameter of the compound is ranged between about 30 and 80 nanometers. The poly-3,4-ethylenedioxy thiophene covers the carbon nanotube. The mass ratio of the poly-3,4-ethylenedioxy thiophene and the multi-wall carbon nanotube is about 1-6:1.

The conductive nanomaterials are deposited on the carrying layer 12 by a laser direct structuring (LDS) to form the square-wave shaped radiator 14. The feed end 144 connects a feeder line 15 for electrically connecting a radio frequency (RF) chip (not shown).

Figure 2:
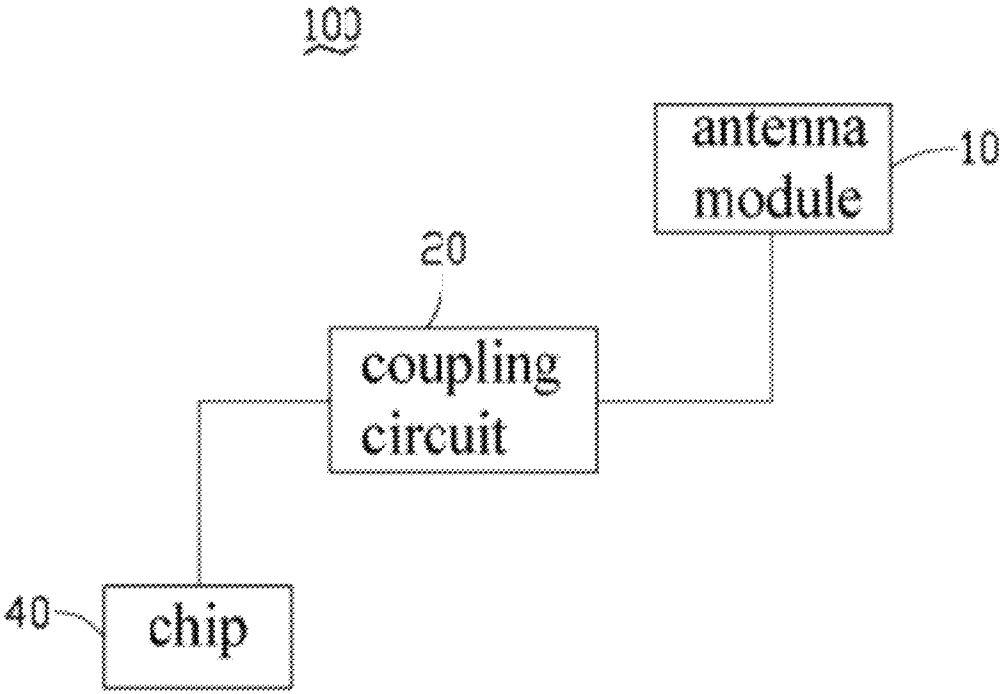
FIG. 2 is a flow chart of a wireless communication device, according to a first exemplary embodiment.

FIG. 2 shows a flow chart of a wireless communication device 100 including the antenna module 10, a coupling circuit 20, and a chip 40. The antenna module 10 can be assembled in the wireless communication device 100. The coupling circuit 20 can improve performance of the antenna module 10. The coupling circuit 20 can be an inductive, a capacitive, T-typed circuit.

After assembly, the grounding end 142 is in a suspending state. The feed end 144 electrically connects an end of the coupling circuit 20. Another end of the coupling circuit 20 electrically connects the chip 40.

In use, the FM signals are received by the radiator 14, and transmitted into the coupling circuit 20 through the feed end 144, further transmitted into the chip 40.

Figure 3:
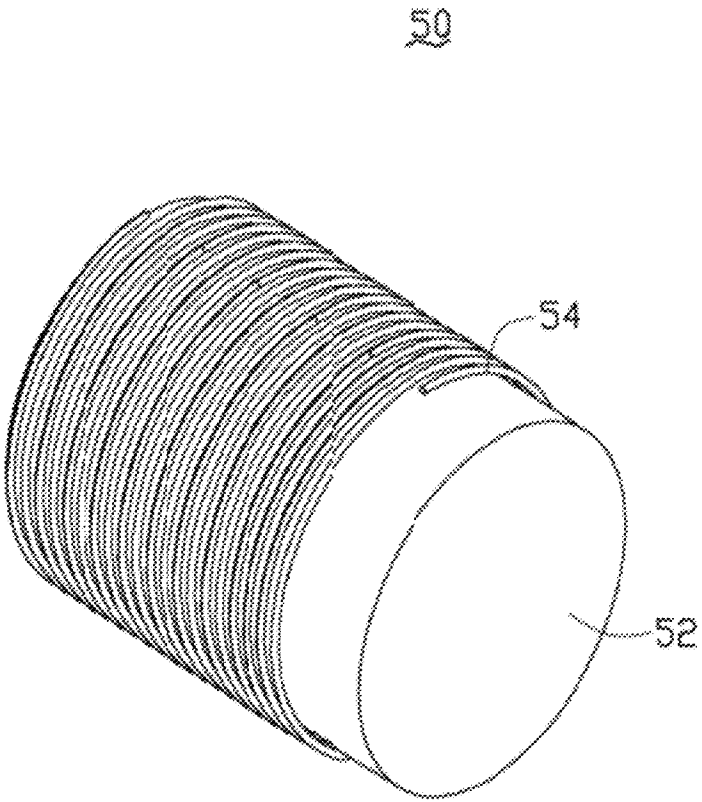
FIG. 3 is an isometric view of an antenna module, according to a second exemplary embodiment.

FIG. 3 shows a second exemplary antenna module 50 including a carrying layer 52 and a radiator 54 formed on the carrying layer 52. The carrying layer 52 is a cylinder made of plastics. The carrying layer 52 is made of a high permittivity or high magnetic conductivity material, such as ceramic, for improving performance of the antenna module 50.

The radiator 54 is a coil. The radiator 54 coils around the carrying layer 52. The radiator 54 can be made of conductive nanomaterials. The conductivity of the nanomaterials are greater than or equal to about $5.8\times10^7$ S/m. An end of the radiator 54 electrically connects a feeder line (not shown). Another end of the radiator 54 is in a suspending state.

Figure 4:
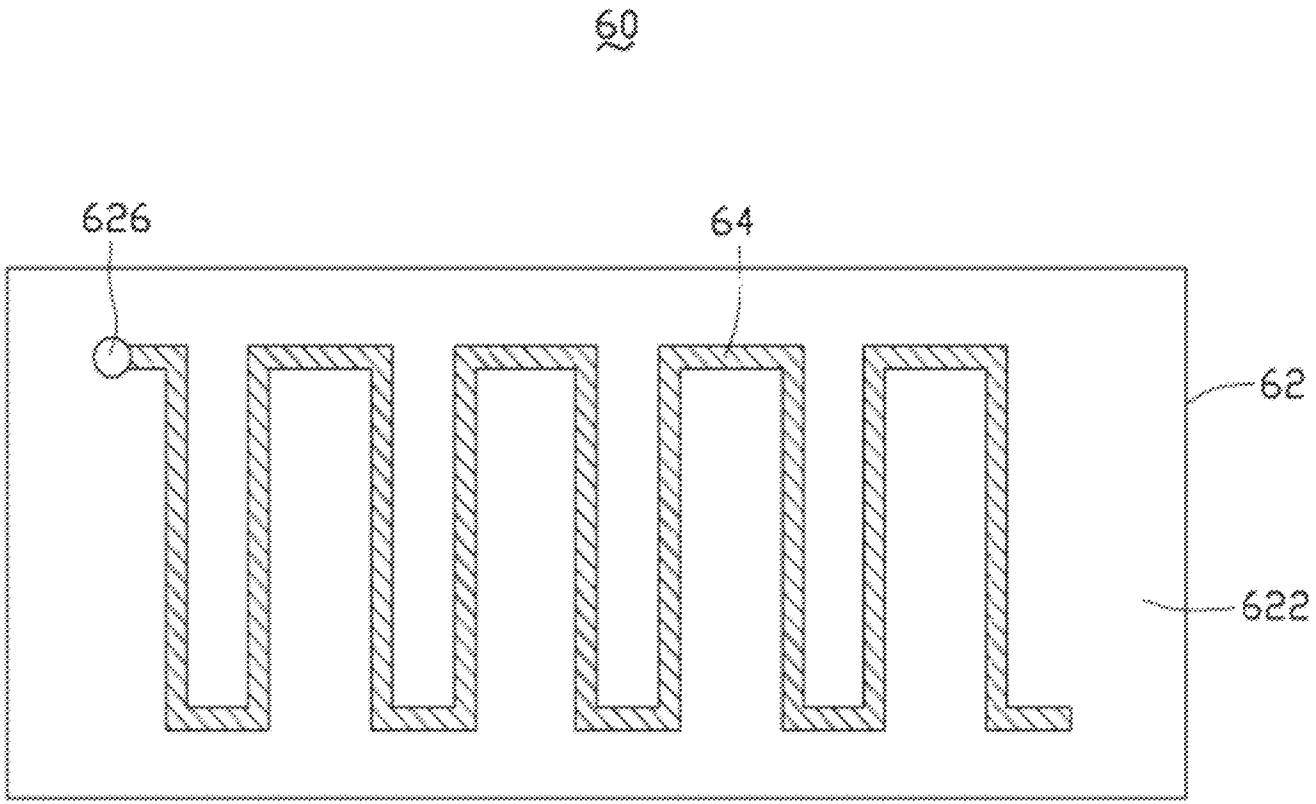
FIG. 4 is a partially, front-on view of an antenna module, according to a third exemplary embodiment.
Figure 5:
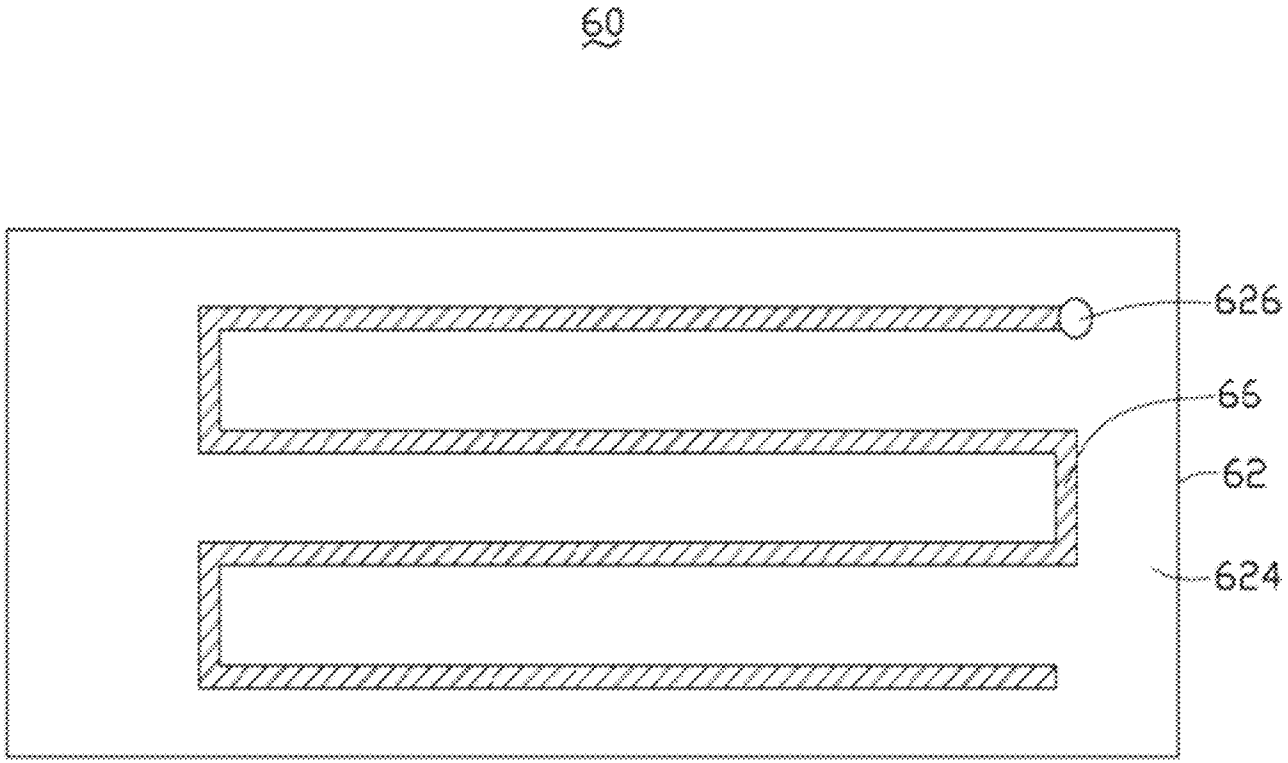
FIG. 5 is the antenna module shown in FIG. 4, but in another position.
Figure 6:
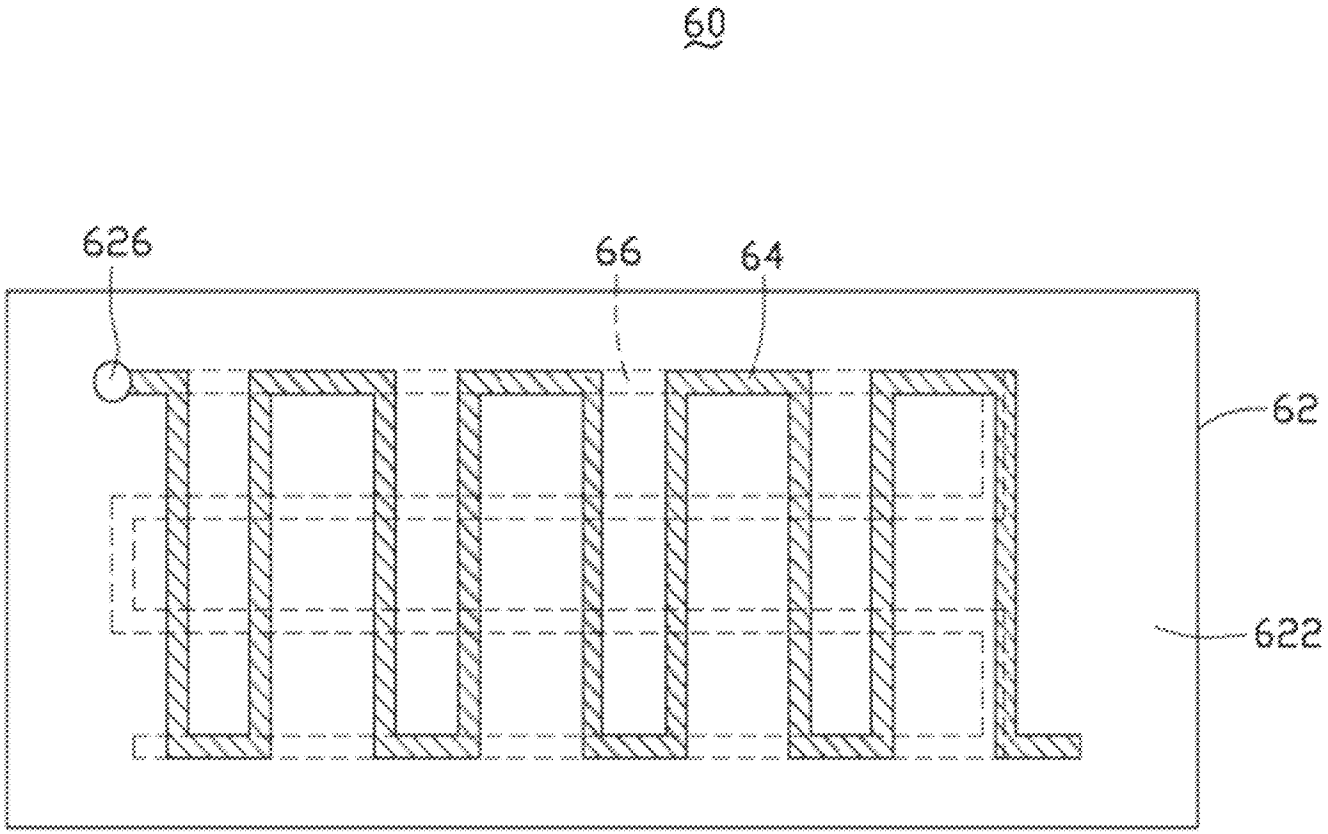
FIG. 6 is a front-on view of the antenna module shown in FIG. 4.

FIG. 4 through FIG. 6 show a third exemplary antenna module 60 including a carrying layer 62, a first antenna unit 64, and a second antenna unit 66. The carrying layer 62 can be made of insulating materials, and includes a first surface 622 and a second surface 624 parallel to the first surface 622. The carrying layer 62 defines a through hole 626.

The first antenna unit 64 and the second antenna unit 66 cooperatively form a radiator of the antenna module 60. The first antenna unit 64 and the second antenna unit 66 can be made of conductive nanomaterials. The conductivity of the nanomaterials are greater than or equal to about $5.8\times10^7$ S/m. The conductive nanomaterials are deposited on the carrying layer 62 by a LDS process to form the square-wave shaped first antenna unit 64. The conductive nanomaterials are vertically arrayed on the first surface 622. The conductive nanomaterials are further horizontally arrayed on the second surface 624 to form the square-wave shaped second antenna unit 66. An end of the first antenna unit 64 is in a suspending state. Another end of the first antenna unit 64 passes the through hole 626 and electrically connects an end of the second antenna unit 66. Another end of the second antenna unit 66 electrically connects a feeder line (not shown).

The antenna module is made of conductive nanomaterials for receiving FM signals, which decreases the size and eliminates the need of applying any earphones or other accessories for listening to the FM broadcasting programs.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna module, comprising:

a radiator made of nanomaterials; the conductivity of the nanomaterials greater than or equal to about 5.8×107S/m;

wherein the nanomaterials are made of carbon nanotube conductive fiber, the carbon nanotube conductive fiber includes dispersant about 0.1-5% by weight, and the dispersant is selected from a group consisting of alkylbenzene sulfonate and alkyl sulfate.

2. The antenna module as claimed in claim 1, wherein the carbon nanotube conductive fiber further includes carbon nanotube about 0.1-5% by weight, and thermoplastic polymer about 100% by weight.

3. The antenna module as claimed in claim 1, further comprising a carrying layer, a first antenna unit, and a second antenna unit; the first antenna unit formed on a first surface of the carrying layer; the second antenna unit is formed on the second surface of the carrying layer paralleling to the first surface.

4. The antenna module as claimed in claim 3, wherein the carrying layer defines a through hole, an end of the first antenna unit passes through the through hole and electrically connects an end of the second antenna unit.

5. The antenna module as claimed in claim 1, further comprising a carrying layer, the radiator is formed on the carrying layer in square-wave shaped or coils around the carrying layer.

6. A wireless communication device, comprising:

a chip;

an antenna module, comprising:

a radiator made of nanomaterials; the conductivity of the nanomaterials greater than or equal to about 5.8×107S/m; the radiator; and a coupling circuit electrically connecting the chip to the radiator wherein the nanomaterials are made of a compound of poly-3, 4-ethylenedioxy thiophene/multi-wall carbon nanotube, and the diameter of the carbon nanotube in the compound is ranged between about 20 and about 40 nanometers, and the length of the carbon nanotube in the compound is ranged between about 200 and about 5000 nanometers; the diameter of the compound is ranged between about 30 and about 80 nanometers; the poly-3, 4-ethylenedioxy thiophene covers the carbon nanotube; the mass ratio of the poly-3, 4-ethylenedioxy thiophene and the multi-wall carbon nanotube is about 1-6:1.

7. An antenna module, comprising:

a radiator made of nanomaterials; the conductivity of the nanomaterials greater than or equal to about 5.8×107S/m;

wherein the nanomaterials are made of carbon nanotube conductive fiber, the carbon nanotube conductive fiber includes carbon nanotube about 0.1-5% by weight, dispersant about 0.1-5% by weight, and thermoplastic polymer about 100% by weight;

wherein the dispersant is selected from a group consisting of alkylbenzene sulfonate and alkyl sulfate.

* * * * *